US007257974B2

(12) United States Patent
Steffens

(10) Patent No.: US 7,257,974 B2
(45) Date of Patent: Aug. 21, 2007

(54) DEEP-ROLLING ROLLER HEAD OF A DEEP-ROLLING TOOL

(75) Inventor: Hans-Toni Steffens, Erkelenz (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 0 days.

(21) Appl. No.: 11/266,944

(22) Filed: Nov. 4, 2005

(65) Prior Publication Data

US 2007/0084262 A1 Apr. 19, 2007

(30) Foreign Application Priority Data

Oct. 18, 2005 (DE) ..... 10 2005 049 646

(51) Int. Cl.
*B21D 15/00* (2006.01)

(52) U.S. Cl. ..... 72/110

(58) Field of Classification Search ..... 72/107; 11/110; 29/6.01

See application file for complete search history.

(56) References Cited

U.S. PATENT DOCUMENTS 6,257,037 B1 * 7/2001 Lonero et al. ..... 72/110
6,393,886 B1 * 5/2002 Bagusche ..... 72/110
6,601,424 B2 * 8/2003 Bagusche ..... 72/110
7,100,412 B2 * 9/2006 Derichs ..... 72/110
7,100,413 B2 * 9/2006 Derichs ..... 72/110

* cited by examiner

*Primary Examiner*—Ed Tolan
(74) *Attorney, Agent, or Firm*—Proskauer Rose LLP

(57) ABSTRACT

The invention relates to a deep-rolling roller head (1) of a deep-rolling tool for deep-rolling, by means of deep-rolling-rollers (2), radii or recesses (3) on the main (4) and lifting bearing journal of a crankshaft, while the crankshaft rotates in a rotational direction (5). The deep-rolling roller head (1) has a prismatic, flat, approximately rectangular housing (6) on whose one front side (7), which faces the bearing journals (4) to be deep-rolled of the crankshaft, two roller cages (8, 9) are provided. The roller cages (8, 9) each have first front sides (10, 11), which are at a mutual distance (12) from each other and at the same time at a distance (13, 14) from the longitudinal center (15) of the housing (6). The roller cages (8, 9) have recesses (16), in which deep-rolling rollers of (2) are loosely rotatably guided in a removable manner with play. The roller cages (8, 9) are supported in each case with second front sides (17, 18) on parts of the housing (6) or on elements, which are adjustably fixed to the housing (6). The section (19) of the front side (7) of the housing (6) facing away from the rotational direction (5) has a projection (20) on which the roller cage (8) is supported with its second front side (17). An L-shaped retainer (22), which can be adjusted and fixed relative to the housing (6) is provided on the section (21) of the housing (6) facing the rotational direction (5) of the crankshaft. The second roller cage (9) is supported with its second front surface (18) on the end (25) of the long arm (26) of the retainer (22).

2 Claims, 1 Drawing Sheet

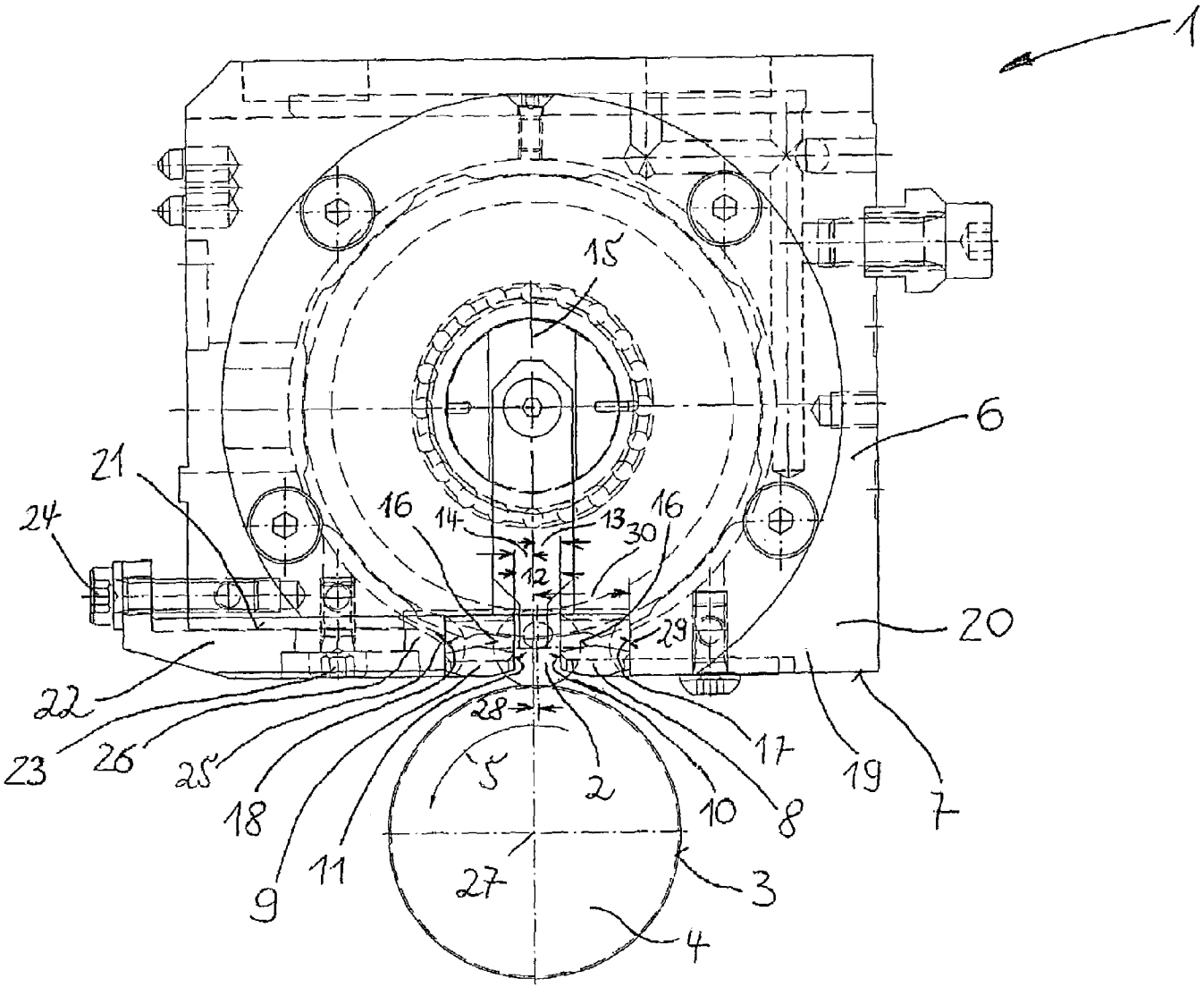
1
6
20
7
19
17
8
10
3
4
2
29
16
30
13
15
12
14
28
5
27
11
9
18
25
26
23
22
21
24

DEEP-ROLLING ROLLER HEAD OF A DEEP-ROLLING TOOL

The invention relates to a deep-rolling roller head of a deep-rolling tool according to the preamble of the first patent claim.

Deep-rolling roller heads of this kind are well-known. Thus for example from WO 03/090972 A1 a deep-rolling roller head of a deep-rolling tool for hard rolling radii or recesses on the main and lifting bearing journals of crankshafts is known with a housing, in which one or two deep-rolling rollers are loosely rotatably guided in a roller cage at a lateral distance from each other with little play. The roller cage is fixed on the lower side of the housing, which faces the crankshaft by means of pins, which respectively support the roller cage on its front sides opposing the deep-rolling rollers and simultaneously laterally guide the same. The housing of the deep-rolling roller head is respectively provided with a projection on both ends of its lower side facing the crankshaft for supporting the roller cage. Pins are provided as fixing and guiding elements for the roller cage and engage in the roller cage.

From WO 2004/004972 A1 another deep-rolling roller head of a deep-rolling tool is known with deep-rolling rollers, mounted to rotate in roller cages, which have a distance from the middle of the underside of the housing of the deep-rolling roller head and are supported on the front side at the end of the long arm of two L-shaped retainers, which may be adjusted and fixed in the direction of the middle. A screw engages in a longitudinal hole of the long arm in each case, by means of which the L-shaped retainer is fixed to the underside of the housing, whilst a second screw engages in a drilling in the adjacent front side of the housing through in each case a drilling in the short arm and is provided for the precise locating of the roller cage in relation to the middle. In the case of the known L-shaped retainer the front side adjacent to the underside has a given first distance from the middle on a section of its length. The corresponding short arm is supported on a shoulder of the inner side thereof on the section of the housing. The front side of the corresponding long arm which supports the roller cage has a given second distance from said section.

Finally from WO 03/090971 A1 the deep-rolling roller head of a deep-rolling tool, as it is used for deep-rolling radii or recesses on the main and lifting bearing journals of crankshafts is known with a housing, inside of which one or two laterally interspaced deep-rolling rollers are loosely rotationally guided in a removable manner and with little play in two roller cages. The roller cages are fastened to supports on the front side of the housing oriented toward the crankshaft. Said supports support the roller cages on their faces oriented away from the deep-rolling rollers while laterally guiding them at the same time. The front side of the housing oriented toward the crankshaft is provided on both ends thereof with a projection for supporting each of the roller cages. A fastening and guiding element is provided for each roller cage and engages to the roller cage and can be fastened to one of the projections of the housing at the same time.

It is common to the known deep-rolling roller heads that close tolerances must be kept for mounting the roller cages. Close tolerances increase the manufacturing cost of the tool. For this reason the object of the present invention is based on reducing the number of pieces or sections of the deep-rolling roller head, which for mounting the roller cages must be fabricated within narrow production tolerances. At the same time it should be possible to continue to use elements, such as for example the L-shaped retainers as they are actually known and customary. Finally it should be possible with this innovation, created in this way, to repair any wear arising on the roller cage facing the rotational direction of the crankshaft with simple means.

According to the invention this object is achieved in that the section of the front side of the housing of the deep-rolling roller head facing away from the rotational direction of the crankshaft has a projection on which one of the roller cages is supported with its front side, which lies opposite the front side, in which the deep-rolling roller is guided. An actually known L-shaped retainer, which can be adjusted and fixed relative to the housing and on the end of whose long arm the other roller cage of the deep-rolling tool is supported with its front side, which again lies opposite the front side, in which the deep-rolling roller is guided, is provided on the section of the housing of the deep-rolling roller head facing the rotational direction of the crankshaft.

In this way it becomes possible to continue to use the presently known and customary L-shaped retainers for mounting the roller cages on the deep-rolling roller heads without having to provide new constructions for this and to compensate any wear of the roller cage on the front side facing the rotational direction of the crankshaft by simply re-adjusting the L-shaped retainer. Re-adjustment is uncomplicated and can be performed by a technician without requiring additional specialist adjusting help. As a result of the roller cage opposing the rotational direction of the crankshaft resting on a front surface of a projection of the housing of the deep-rolling roller head, whose distance from the longitudinal centre of the housing is specified precisely and can also be kept within close tolerances, such advantageous simplifications already result from this arrangement so that specialist help for adjusting the deep-rolling rollers is no longer necessary. Also an offset, with which the deep-rolling roller is arranged against the rotational direction of the crankshaft relative to the longitudinal centre of the housing of the deep-rolling roller head, can be realized without special effort. The offset ranges between 0.1 and 1 mm, preferably 0.2 mm. Instead of several exactly matching shoulders, as they are known from the prior art detailed at the beginning, only one exactly matching shoulder face is needed, that is to say the one on the projection of the housing.

Further advantages will become apparent from the features of the sub-claims.

The invention is described in detail below by way of an exemplary embodiment.

The single drawing, which is approximately true to scale, shows a deep-rolling roller head in a view from the side.

The deep-rolling roller head 1 of a deep-rolling tool for deep-rolling, by means of deep-rolling-rollers 2 of radii or recesses 3, which in the present case are illustrated by a broken circular line, on the main and lifting bearing journals 4 of a crankshaft (not shown), while the crankshaft rotates in a rotational direction 5, has a prismatic, flat, approximately rectangular housing 6. Two roller cages 8 and 9 are arranged on a front side 7 of the housing 6, which faces the bearing journal 4 to be hard rolled of the crankshaft. The two roller cages 8 and 9 each have a first front side 10 and 11, which are at a mutual distance 12 from each other and at the same time are at a distance 13 and 14 from the longitudinal centre 15 of the housing 6. Recesses 16, in which the deep-rolling rollers 2 are loosely rotatably guided are provided inside the front sides 10 and 11. On the second front sides 17 and 18 of the roller cages 8 and 9 lying opposite the first front sides 10 and 11 the roller-cages are supported on parts of the housing 6 or on elements, which are adjustably fixed to the housing 6. The section 19 of the front side 7 of the housing 6 facing away from the rotational direction 5 of the crankshaft has a projection 20, on which the roller cage 8 is supported with its second front side 17. An L-shaped retainer 22, as it is actually known per se from the prior art is supported on the section 21 of the housing 6 facing the rotational direction 5 of the crankshaft. The L-shaped retainer 22 can be adjusted and fixed relative to the housing 6 by means of screws 23 and 24. The other roller cage 9 is supported with its second front side 18 on the outer end of 25 of the long arm 26 of the L-shaped retainer 22.

The longitudinal centre 15 of the housing 6 and the rotation centre 27 of the bearing journal 4 of the crankshaft lie in one and the same plane. The rotation centre of the deep-rolling roller 2 is shifted relative to this plane by an offset 28 against the rotational direction 5 of the crankshaft. The offset 28 ranges between 0.1 and 1 mm, preferably 0.2 mm.

The projection 20 of the front side 7 of the housing 6 has a supporting surface 29, on which the second front side 17 of the roller cage 8 lies and is supported. The supporting surface 29 is from the longitudinal centre 15 of the housing 6 at a distance 30, which is larger by the offset 28 than the distance, at which the outer end 25 of the long arm 26 of the L-shaped retainer 22 is from the longitudinal centre 15 of the housing 6. In this case it is presumed that the two roller cages 8 and 9 each have the same dimensions.

REFERENCE SYMBOL LIST

1 deep-rolling roller head
2 deep-rolling roller
3 recess
4 main and lifting bearing journals
5 rotational direction
6 housing
7 front side
8 roller cage
9 roller cage
10 first front side
11 first front side
12 mutual distance
13 distance
14 distance
15 longitudinal centre
16 recess
17 second front side
18 second front side
19 section
20 projection
21 section
22 L-shaped retainer
23 screw
24 screw
25 outer end
26 long arm
27 rotation centre
28 offset
29 supporting surface
30 distance

The invention claimed is:

1. Deep-rolling roller head of a deep-rolling tool for deep-rolling, by means of deep-rolling rollers, radii or recesses on the main and lifting bearing journal of a crankshaft, while the crankshaft rotates in a rotational direction, with a prismatic, flat approximately rectangular housing, on whose one front side, which faces the bearing journals to be deep-rolled of the crankshaft, two roller cages are arranged, each having first front sides, which are at a mutual distance from each other and at the same time at a distance from the longitudinal centre of the housing as well as having recesses, in which at least one deep-rolling roller is rotatably guided loosely with play and which each have second front sides, supported on parts of the housing or on an L-shaped retainer having at least one long arm, which is arranged so that it can be adjusted and fixed on the housing, wherein a section of the front side of the housing facing away from the rotational direction of the crankshaft has a projection, on which one of the roller cages is supported with its second front side, whilst the L-shaped retainer, which can be adjusted and fixed relative to the housing, is provided on a section of the housing facing the rotational direction of the crankshaft and the other roller cage is supported with its second front side on an end of a long arm of the L-shaped retainer wherein the longitudinal centre of the housing and the rotation centre of the bearing journal to be deep-rolled of the crankshaft lie in the same plane, in relation to which the rotation centre of the deep-rolling roller(s) is shifted by an offset against the rotational direction of the crankshaft, the projection of the front side having a supporting surface for the second front side of one of the two roller cages, which is at a given distance from the longitudinal centre of the housing and is greater by an amount of the offset than a distance of the end of the long arm of the L-shaped retainer from the longitudinal centre of the housing.

2. Deep-rolling roller head according to claim 1, wherein the offset ranges between 0.1 and 1 mm, preferably 0.2 mm.

* * * * *